United States Patent [19]

Kobayashi et al.

[11] Patent Number: 4,991,074

[45] Date of Patent: Feb. 5, 1991

[54] LIGHTING LAMP

[75] Inventors: Yasuo Kobayashi; Yasuo Hirasawa; Churyo Kodama; Katsumi Miyazaki; Takao Higashi, all of Tokyo; Masami Yanagisawa; Akinori Sei, both of Shizuoka, all of Japan

[73] Assignees: Tomoegawa Paper Co., Ltd.; Hitachi Ltd., both of Tokyo, Japan

[21] Appl. No.: 404,514

[22] Filed: Sep. 8, 1989

[30] Foreign Application Priority Data

Jul. 26, 1989 [JP] Japan ..... 1-191390

[51] Int. Cl.[5] ..... F21S 13/00

[52] U.S. Cl. ..... 362/457; 356/215; 116/216

[58] Field of Search ..... 313/634, 317, 493, 573; 116/216; 374/161; 356/213, 215; 362/457

[56] References Cited

U.S. PATENT DOCUMENTS

| | | | |
|---|---|---|---|
| 2,049,867 | 8/1936 | Richards | 116/216 |
| 4,212,153 | 7/1980 | Kydonieus et al. | 116/216 |
| 4,737,463 | 4/1988 | Bhattacharjee et al. | 116/216 |

*Primary Examiner*—Ira S. Lazarus
*Assistant Examiner*—Sue Hagarman
*Attorney, Agent, or Firm*—Cushman, Darby & Cushman

[57] ABSTRACT

A lighting lamp having a display sheet laminated on the surface of a bulb thereof, said display sheet comprising a support having laminated thereon a light-susceptible layer including an active layer containing at least one of a dye and a pigment capable of coloring, fading, or discoloring by the action of an active light and an adhesive layer formed on the surface of the light-susceptible layer such that the portion corresponding to at least the display portion thereof is exposed, and being laminated on the surface of the bulb by the adhesive layer.

6 Claims, 3 Drawing Sheets

FIG. 1A
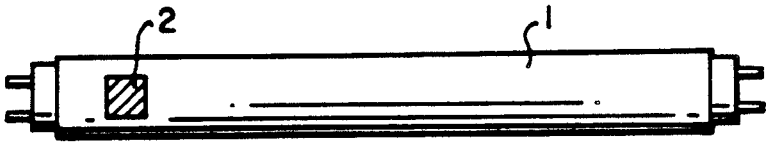
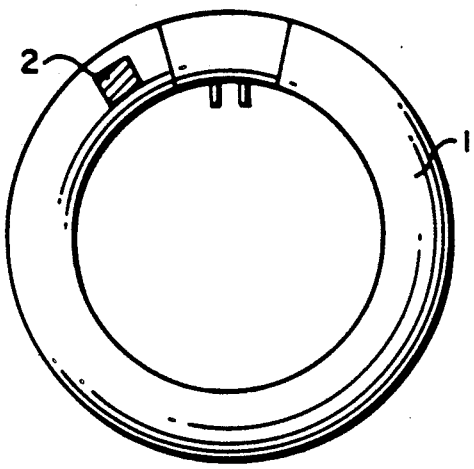
FIG. 1B
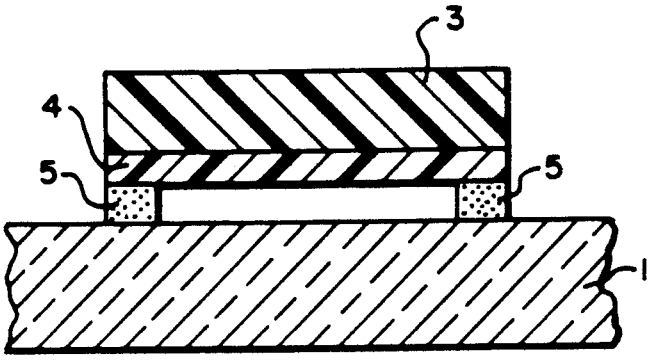
FIG. 2

LIGHTING LAMP

FIELD OF THE INVENTION

This invention relates to a lighting lamp having laminated thereon a display sheet displaying the life of the lamp.

BACKGROUND OF THE INVENTION

A lighting lamp such as a fluorescent lamp, etc., has a definite lamp life and since the lifeless lighting lamp must be renewed, it has been desired to detect the lamp life left of a lighting lamp before the termination of the life of the lighting lamp for renewing the lamp. Hitherto, the lamp life of a lighting lamp is determined by observing the blackened phenomenon at the end portion of the bulb.

Also, it is known to apply an organic material such as a coating material, etc., capable of being discolored or faded by the action of ultraviolet rays to the surface of a bulb of a lighting lamp and determine the lamp life by the extent of the discoloration or fading. The display of the integrated lighting time or the previous notice of life of a lighting lamp in these conventional techniques is performed by a material capable of coloring, fading, or discoloring by the active light from the lamp or a display sheet using the material as disclosed, e.g., in JP-A-U-53-14057 and JP-A-U-622-1133366 (the term "JP-A-U" as used herein means an "unexamined published Japanese utility model application") and JP-A-64-65766 (the term "JP-A" as used herein means an "unexamined published Japanese patent application").

Now, in a display sheet, a supply of oxygen is required for causing coloring, fading, or discoloring of the active layer thereof and if the supply of oxygen is insufficient, there occurs a problem that the progress of coloring, fading, or discoloring of the active layer becomes unreliable by causing unevenness in coloring, fading, or discoloring, etc., whereby accurate display becomes impossible.

In the aforesaid conventional techniques, no consideration is made of the manner of attaching the display sheet to a lamp. There is a problem that when the display sheet is attached to a lamp, unevenness in coloring, fading, or discoloring of the active layer occurs, whereby accurate display of the life of the lamp becomes impossible.

SUMMARY OF THE INVENTION

The present invention has been made for solving the aforesaid problems in conventional techniques.

The object of this invention is, therefore, to provide a lighting lamp capable of accurately displaying the life of the lamp.

The inventors have discovered that the aforesaid object can be attained by locally forming an adhesive layer such that a hollow space is formed between the light-susceptible layer (including the active layer) of a display sheet and the surface of a bulb of a lighting lamp for enabling the supply of oxygen into the active layer, and have succeeded in accomplishing the invention based on the discovery.

That is, the lighting lamp of this invention has a display sheet laminated on the surface of a bulb of the lamp and in the first embodiment of this invention, a display sheet comprising a support having formed on one surface thereof a light-susceptible layer including an active layer containing at least one of a pigment and a dye capable of coloring, fading, or discoloring by the action of an active light and an adhesive layer formed on the surface of the light-susceptible layer such that a portion corresponding to at least the display portion is exposed, the display sheet being laminated on the surface of the bulb of the lamp by the adhesive layer.

In the second embodiment of this invention, a display sheet comprising a support having formed on one surface thereof a light-susceptible layer including an active layer containing at least one of a pigment or a dye capable of coloring, fading, or discoloring by the action of an active light and an adhesive layer formed on the surface of the light-susceptible layer such that a portion corresponding to at least the display portion is exposed, a masking print being applied to the other surface of the support, is laminated on the surface of the bulb of the lamp by the adhesive layer.

Also, in the third embodiment of this invention, a display sheet comprising a support having formed on one surface thereof a light-susceptible layer including an active layer containing at least one of a pigment or a dye capable of coloring, fading, or discoloring by the action of an active light and an adhesive layer formed on the surface of the light-susceptible layer such that a portion corresponding to at least the display portion is exposed, a masking print being applied to the other surface of the support and a cover film being formed thereon, the display sheet being laminated on the surface of the bulb of the lamp by the adhesive layer.

In this invention, the light-susceptible layer may be composed of the active layer only or may be composed of, if necessary, the active layer and an active light-adjusting layer. When the light-susceptible layer is composed of the active layer and an active light-adjusting layer, the active light-adjusting layer may be disposed at the lamp side from the active layer or at the support side from the active layer.

In addition, a lighting lamp in this invention means (1) a low-pressure mercury vapor discharging lamp (e.g., a fluorescent lamp), (2) a high-pressure mercury vapor discharging lamp (e.g., a mercury vapor lamp), (3) a high-pressure sodium vapor lamp, (4) a metal vapor discharging lamp (e.g., a metal halide vapor lamp), (5) a discharging lamp on the principle of low-pressure mercury vapor discharging lamp (e.g., a sterilization lamp, a photochemical reaction lamp, a healthy ray lamp, etc.), etc.

BRIEF DESCRIPTION OF THE DRAWINGS

FIG. 1 (*a*) and (*b*) are front views each showing an example of the lighting lamp of this invention, wherein (*a*) is a view showing a straight tube type bulb and (*b*) is a view showing an annular bulb, FIG. 2 is a partial cross-sectional view showing the first embodiment of this invention, wherein a display sheet is laminated on a lamp bulb.

DETAILED DESCRIPTION OF THE INVENTION

The lighting lamp of this invention is explained in detail by referring to the accompanying drawings.

FIG. 1 (*a*) and (*b*) are front views each showing two examples of the lighting lamp of this invention, wherein (*a*) shows the state that a display sheet 2 is attached to a portion near the end of a straight tube type bulb 1 and (*b*) shows the state that a display sheet 2 is attached to a portion near a base of an annular bulb 1.

Figure 3:
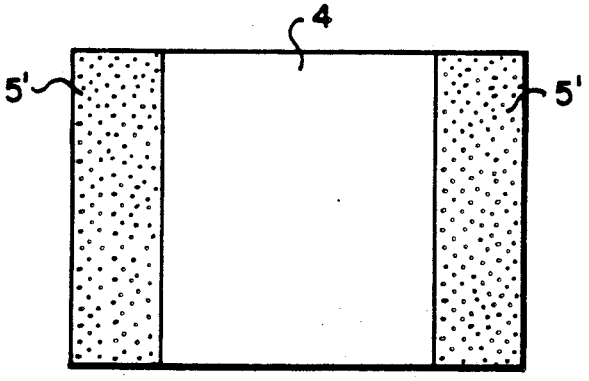
FIG. 3 is a view showing the display sheet in FIG. 2 viewing from the lamp side.

FIG. 2 is a partial cross-sectional view showing the first embodiment of this invention, wherein the display sheet is laminated on the lamp bulb and FIG. 3 is a view showing the display sheet in FIG. 2 viewing from the lamp side.

The display sheet in FIG. 2 has a layer structure composed of a support 3 having a light-susceptible layer comprising an active layer 4 formed thereon at the side facing a bulb 1 and an adhesive layer 5 formed on the light-susceptible layer. The display sheet is attached to a bulb 1 by the adhesive layer 5. Also, the adhesive layer 5 is formed on both sides of the display sheet in stripe-forms as shown in FIG. 3. In addition, the additive layers 5' in FIG. 3 show that the adhesive layers are in stripe forms.

Figure 4:
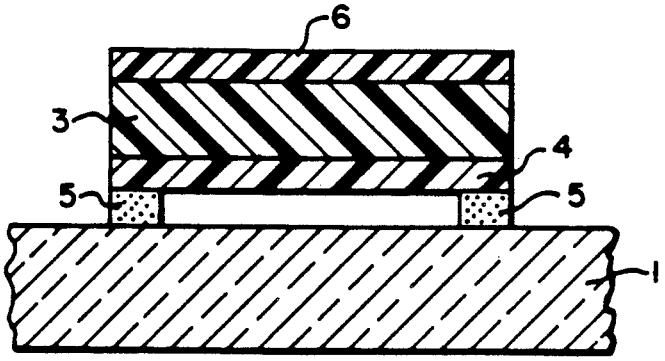
FIG. 4 is a partial cross-sectional view showing the second embodiment of this invention, wherein a display sheet is laminated on the lamp bulb.

FIG. 4 is a partial cross-sectional view showing the second embodiment of this invention, wherein the display sheet is laminated on a lamp bulb 1 and the display sheet has a layer structure that a light-susceptible layer composed of an active layer 4 is formed on a support 3 at the side facing the bulb 1 and an adhesive layer 5 is formed on the light-susceptible layer, a masking print 6 being further applied to the other surface of the support for shading the adhesive layer 5 and discriminating the color tone of the active layer 4 from the color tone of the peripheral portion of the display sheet.

Figure 5:
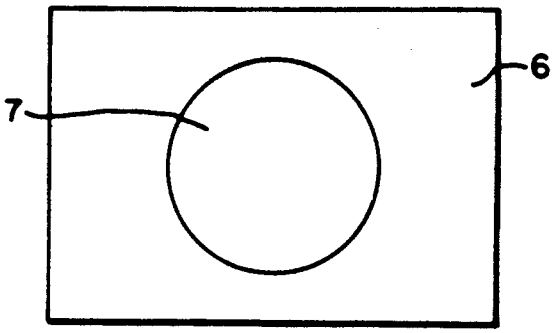
FIG. 5 is a planar view of FIG. 4 seeing from above.

FIG. 5 is a planar view of FIG. 4 shown from above, which shows a state of being not applied with the masking print 6 in the circle of a display portion 7.

Figure 6:
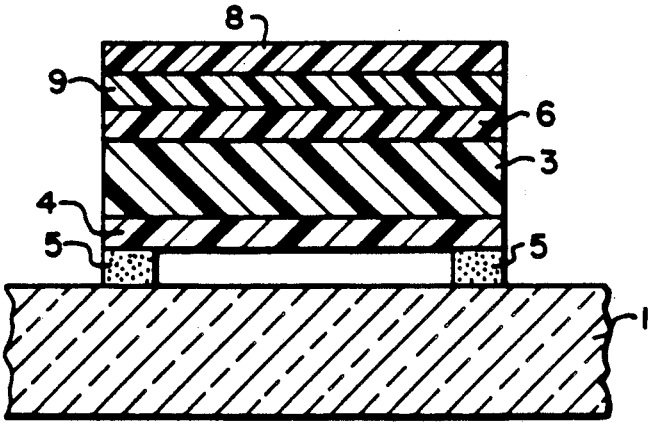
FIG. 6 is a partial cross-sectional view showing the third embodiment of this invention, wherein a display sheet is laminated on the lamp bulb, and FIG. 7 and FIG. 8 each show a partial cross-sectional view showing other, examples of the first embodiment of this invention, wherein a display sheet is laminated on the lamp bulb.

FIG. 6 shows a partial cross-sectional view showing the third embodiment of this invention, wherein the display sheet is laminated on a lamp bulb 1 and the display sheet has a layer structure that a light-susceptible layer composed of an active layer 4 is formed on a support 3 at a side facing the bulb 1, an adhesive layer 5 is formed thereon, a masking print 6 is applied on the other surface of the support 3 for shading the adhesive layer 5 and discriminating the color tone of the active layer 4 from the color tone of the peripheral portion of the display sheet, and also a cover film 8 is laminated thereon by a bonding layer 9.

Figure 7:
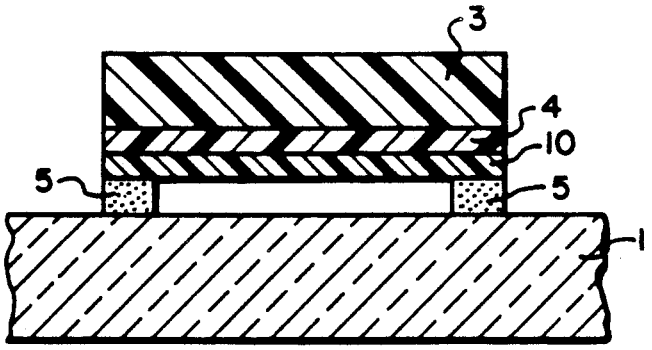
Figure 8:
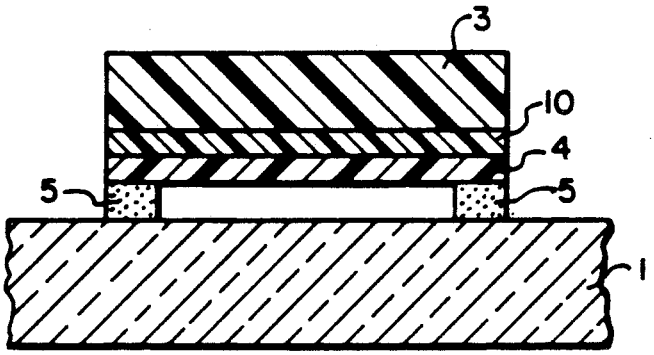

FIG. 7 and FIG. 8 each shows the case of this invention wherein the light-susceptible layer is composed of an active layer 4 and an active light-adjusting layer 10.

FIG. 7 shows an display sheet wherein an active layer 4 and an active light adjusting layer 10 are successively formed on a support 3 on a side of a bulb 1 and an adhesive layer 5 is formed on adjusting layer 10 thereon.

Also, FIG. 8 shows a display sheet wherein an active light-adjusting layer 10 and an active layer 4 are successively formed on a support 3 on the side of a bulb 1- and an adhesive layer 5 is formed on active layer 4.

Then, materials constituting the display sheet in this invention are explained.

In this invention, a transparent or translucent sheet-form support is used and as such supports, there are, for example, cellophane films, polyester films, cellulose triacetate films, polycarbonate films, nylon films, fluorine resin films, polyethylene films, polypropylene films, polyarylate films, TPX films, etc.

The light-susceptible layer formed on the support may be composed of an active layer only. The active layer is a layer containing a composition which causes a color change such as coloring, discoloring, fading, etc., by the action of an active light such as ultraviolet rays, visible rays, etc., and for such a composition, a conventionally known technique can be used.

As a composition which is colored by the action of active light, a combination of an initiator forming an active seed such as a free radical or an acid by the action of ultraviolet rays or visible light and a color former of coloring by the interaction with the aforesaid active seed can be used.

As the initiator forming a free radical, there are organic halogen compounds such as carbon tetrabromide, 1,1,1-tris(bromomethyl)propane, phenyltribromomethylsulfone, p-nitrophenyltribromomethylsulfone, 2,4-dichlorophenyltrichloromethylsulfone, hexabromodimethyl sulfoxide, hexabromodimethylsulfone, 4,4-dibromo-2,3-hexanedione, 4-phenoxydichloroacetophenone, o-nitro$\alpha\alpha\alpha$,-tribromoacetophenone, etc.

Also, as the initiator of forming an acid, there are aromatic onium salts such as diphenyliodonium tetrafluoroborate, diphenyliodonium hexafluorophosphate, triphenylsulfonium hexafluorophosphate, bis(4-methoxyphenyl)phenylsulfonium hexafluorophosphate, etc.

Also, as the color former, there are triphenylmethane series compounds, fluoran series compounds, rhodaminelactam series compounds, phenothiazine series compounds, and phthalide series compounds, such as, for example, bis(4-dimethylaminophenyl}phenylmethane (leucomalachite green), tris(4-dimethylaminophenyl)phenylmethane (Leucocrystal Violet), bis(4-diethylamino-2-methylphenyl)phenylmethane, bis(4-diethylamino-2-methoxyphenyl)phenylmethane, tris(4-diethylamino-2-methylphenyl)methane, bis(4-dibenzylamino-2-methylphenyl)phenylmethane, 4-methoxyphenyl-bis(1-ethyl-2methylindol-3-yl)methane, phenyl-bis(1-n-butyl-2-methylindol-3-yl)methane, 3-diethylaminobenzo[a]-fluoran, 3-dimethylamino-6-methyl-7-chlorofluoran, 3-cyclohexylamine-6l-chlorofluoran 3-(N-methyl-N-phenylamino)-6-(N-ethyl-N-p-tolylamino)fluoran, 3-diethylamino-7-chlorofluoran, 3-dimethylamino-6-methyl-7-chlorofluoroan, 3-(N-cyclohexyl-N-methylamino)-6-methyl-7-anilinofluoran, 3-pyrrolidino-6-methyl-7-anilinofluoran, 3-(N-ethyl-N-isopentylamino)-6-methyl-7-anilinofluoran, 3-(N-ethyl-N-(2-oxoranylmethylamino)-6- methyl-7-anilinofluoran, 3-diethylamino-7-(m-fluoroanilino)fluoran, 3,6-diethylaminofluoran-$\omega$-p-nitrophenylimidolactam, 3,6-diethylaminofluoran-$\omega$-p-chlorophenylimidolactam, 3,7-bis(dimethylamino)-10-benzoylphenothiazine, 3,7-bis(-dimethylamino)-10-acetylphenothiazine, 3,3-bis-dimethylaminophenyl-6-dimethylaminophthalide (Crystal Violet Lactone), 3,3-bisdimethylaminophenyl phthalide (Malachite Green Lactone), 3,3-bis(1-ethyl-2-methylindol-3-yl)-phthalide, 3,3bis(1-butyl-2-methylindol-2-methylindol-3etc.

Also, as the composition capable of being discolored or faded by the action of an active light, compositions containing various kinds of dyes such as diphenylmethane series dyes, triphenylmethane series dyes, thiazine series dyes, oxazine series dyes, xanthene series dyes, anthraquinone series dyes, iminonaphthoquinone series dyes, azomethine dyes, etc., or compositions containing various kinds of pigments such as monoazo series pigments, disazo series pigments, triphenylmethane series pigments, metallic complex salt series pigments, etc., can be used. Furthermore, for accelerating the fading rate or discoloring rate, a composition containing a combination of the aforesaid initiator and the dye or pigment can be used.

Specific examples of the aforesaid dye are Crystal Violet, Bromophenol Blue, Bromocresol Purple, Tetrabromophenol Blue, Bromothymol Blue, Thymol Blue, Tripeolin, Methyl Yellow, Methyl Orange, Methyl Red, Neutral Red, Cresol Red, Indigo Carmine, Bromophenol Red, Alizarine Yellow R, Congo Red, phenolphthalein, Thymolphthalein, etc.

Also, specific examples of the pigment are Hansa Yellow 5G, Benzidine Yellow GR, Vulcan Fast Yellow G, Hansa Yellow 3R, Yellow HR, Permanent Orange GTR, Vulcan Orange, Chromophthal Orange 4R, Permanent Bordeaux FGR, Brilliant Fast Scarlet, Lake Red D, Permanent Carmine FBB, Rhodamine 3B Lake, Victoria Pure Blue Lake, Dianisidine Blue, Naphthol Green B, etc.

The active layer in this invention can be formed by dispersing and dissolving the aforesaid composition in a solvent together with a high molecular weight binder having a film-forming property and coating on a support or on an active light-adjusting layer.

As the high molecular weight binder having film-forming property, there are, for example, cellulose derivatives such as ethyl cellulose, acetyl cellulose, hydroxypropyl cellulose, nitrocellulose, cellulose acetate butyrate, cellulose acetate propionate, etc.; polyvinyl chloride; vinyl chloride copolymers such as a vinyl chloride-vinyl acetate copolymer, a vinyl chloride-vinyl acetate-vinyl alcohol copolymer, etc.; ethylene copolymers such as an ethylene-vinyl acetate copolymer, an ethylene-vinyl alcohol copolymer, an ethylene-vinyl chloride copolymer, etc.; polystyrene; styrene copolymers such as a styrene-butadiene-acrylonitrile copolymer, a styrene-butadiene copolymer, etc.; an acrylonitrile-butadiene copolymer; acrylic resins such as polyacrylic acid esters, polymethacrylic acid esters, and copolymers of these esters, etc.; resins for coating composition such as butyral resins, epoxy resins, alkyd resins, phenol resins, saturated polyester resins, fluoropolymer resins, etc.; and engineering plastics such as polycarbonate, polyarylate, polysulfone, polyether sulfone, aromatic polyester, polyphenylene ether, an acrylonitrile-chlorinated polyethylene-styrene copolymer, etc.

Also, examples of the solvent which is used for forming the active layer are methanol, ethanol, isopropanol, benzene, toluene, xylene, ethyl acetate, isobutyl acetate, acetone, 2-butanone, 4-methyl-2- pentanone, cyclohexanone, tetrahydrofuran, dioxane, methylene chloride, chloroform, 1,2-dichloroethane, 1,1,1-trichloroethane, chlorobenzene, hexane, heptane, cyclohexane, dimethylacetamide, dimethyl sulfoxide, etc.

There is no particular restriction on the quantitative ratio of the components for constituting the active layer but preferred examples thereof are shown below, in which "parts" refer to weight.

| Case of Coloring Layer: | |
|---|---|
| Color Former | 10 parts |
| Initiator | 0.01 to 100 parts |
| High Molecular Weight Binder | 1 to 1000 parts |

| Case of Discoloring Layer or Fading Layer: | |
|---|---|
| Dye or Organic Pigment | 10 parts |
| Initiator | 0 to 100 parts |
| High Molecular Weight Binder | 1 to 1000 parts |

Furthermore, the aforesaid active layer can be used as a laminate of two or more such active layers. For example, a laminate of two or more coloring layers each having different coloring speed, a laminate of two or more discoloring layers or fading layers each having a different fading speed, or a laminate of a coloring layer and a discoloring layer or a fading layer can be employed.

When the light-susceptible layer is composed of an active layer and an active light-adjusting layer in this invention, a layer containing a composition having an absorptive property for active light can be used as the active light-adjusting layer. For example, for the composition having an absorptive property for the wavelength region of an active light having wavelengths of not longer than 450 n.m., a conventionally known ultraviolet light absorptive material can be used. Examples of the ultraviolet light absorber are benzotriazole series compounds, benzophenone series compounds, salicylate series compounds, cyanoacrylate series compounds, and oxalic acid anilide series compounds.

Furthermore, as a material having an absorptive property for the aforesaid wavelength region, fine particles of an inorganic material such as zinc oxide, titanium oxide, tin oxide, bismuth oxide, tungsten oxide, barium titanate, etc., can be used.

Also, by suitably selecting the composition for the active layer, the light-susceptible layer showing an activity to visible light of longer than about 450 n.m. can be formed and in such a case, various kinds of dyes or pigments absorbing the active light can be used.

The active light-adjusting layer can be formed by dispersing and dissolving the aforesaid active light absorptive material in a solvent together with a film-forming high molecular weight binder to provide a coating composition and coating the coating composition on a support or an active layer.

Examples of the film-forming high weight molecular binder are cellulose derivatives such as ethyl cellulose, hydroxypropyl cellulose, nitrocellulose, cellulose acetate butyrate, cellulose acetate propionate, etc.; polyvinyl chloride; vinyl chloride copolymers such as a vinyl chloride-vinyl acetate copolymer, a vinyl chloride-acrylate copolymer, etc.; ethylene copolymers such as an ethylene-vinyl acetate copolymer, an ethylene-vinyl alcohol copolymer, an ethylene-vinyl chloride copolymer, etc.; polystyrene; styrene copolymers such as a styrene-butadiene copolymer, a styrene-acrylonitrile copolymer, etc.; acrylic resins such as polyacrylic acid esters, polymethacrylic acid esters, and copolymers of these esters; resins for coating composition, such as epoxy resins, alkyd resins, phenol resins, saturated polyester resins, fluoropolymer resins, etc.; and engineering resins such as polycarbonate, polyarylate, polysulfone, polyether sulfone, aromatic polyester, polyphenylene ether, an acrylonitrile-chlorinated polyethylene-styrene copolymer, etc.

Examples of the solvent for use in the aforesaid case are methanol, ethanol, isopropanol, benzene, toluene, xylene, ethyl acetate, isobutyl acetate, acetone, 2-butanone, 4-methyl-2-pentanone, cyclohexanone, tetrahydrofuran, dioxane, methylene chloride, chloroform, 1,2-dichloroethane, 1,1,1-trichloroethane, chlorobenzene, hexane, heptane, cyclohexane, dimethylacetamide, dimethyl sulfoxide, etc.

The quantitative ratio of the active light-absorbing material and the high molecular weight binder in the active light-adjusting layer is suitably from 0.1 to 1000 parts by weight of the latter to 1 part by weight of the former. Also, the thickness of the layer is from 0.1 to 100 μm, and preferably from 0.5 to 50 μm.

The adhesive layer formed on the light-susceptible layer is formed by coating a coating composition containing at least one of adhesives such as natural rubber series, SBR series, acrylic series, butyl rubber series, thermoplastic elastomer series, silicone series, vinyl acetate series, vinyl chloride series, epoxy series, polyamide series, EVA series, urethane series, denatured acrylic series, acrylate-vinyl acetate series, etc. The thickness of the adhesive layer is set in the range of from 1 to 100 μm, and preferably from 5 to 30 μm.

The adhesive layer is formed such that the portion corresponding to the display portion of the light-susceptible layer is exposed. For example, the adhesive layer may be formed on the opposite edges portions to each other as shown in FIG. 3 or may be formed in other form, such as a ring form or U-form, etc. After all, the adhesive layer may be formed in any form if a portion corresponding to the display portion of the light-susceptible layer is exposed without being covered by the adhesive layer.

Also, when a masking print is applied to other surface of the support, the masking print can be applied by printing a desired pattern on the support using a printing ink for relief printing, lithographic printing, intaglio printing, flexography, gravure, screen printing, etc. The masking print acts the roles of (1) hiding the adhesive layer, (2) enabling the finding of the extent of the change of hue or fading the colored, discolored, or faded layer, and (3) utilizing the print as a decorative label by printing a desired design.

As the cover film as shown in FIG. 6, a polyester film, a cellophane film, a cellulose triacetate film, a polycarbonate film, a nylon film, a fluoropolymer resin film, a polyethylene film, a polypropylene film, a polyarylate film, a TPX film, etc., can be used.

When an influence of external light exists, a ultraviolet light-absorptive film or a colored film prepared by coating a ultraviolet light absorber or kneaded with a ultraviolet light absorbent can be, if necessary, used as the cover film.

By attaching the aforesaid display sheet to a desired portion of the bulb surface of a lighting lamp, a lighting lamp capable of displaying the life thereof can be obtained.

The action that the active layer constituting the light-susceptible layer of the display sheet is colored, faded, or discolored by an active light from a lamp needs oxygen. Since in the lighting lamp of this invention, there exists a portion of being not covered by the adhesive layer on the light-susceptible layer of the display sheet, a hollow space is formed between the portion and the surface of the lamp, which makes it possible to supply oxygen to the active layer. Accordingly, the coloring, fading or discoloring rate of the display portion in the display sheet is stabilized and also color unevenness does not occur, whereby the life of the lamp can be accurately determined.

When the masking print is applied to the support at the opposite side to the light-susceptible layer-carrying side excluding the display portion, the active layer adjusting the adhesive layer is masked, whereby unevenness of coloring, fading or discoloring occurring at the portion is hidden to make accurate determination of the life without making erroneous determination. Also, by printing a desired design on the support, the print can be utilized as a decorative label.

Furthermore, when a cover film is laminated on the aforesaid masking print, the printed surface can be protected from being stained or scratched by handling as well as limiting fading of the printing ink.

Then, the invention is further described in more detail by the following examples but the invention is not limited thereby. In addition, "parts" in the examples are by weight unless otherwise indicated.

EXAMPLE 1

On one surface of a transparent polyester film of 50 μm in thickness was coated a coating composition for active layer having the composition shown below to form an active layer composed of an azoic yellow pigment and a high molecular weight binder and having a thickness of 4 μm. Then, a coating composition for forming adhesive layer having the composition shown below was coated on the active layer at the two opposite marginal portions to form adhesive layers each having a thickness of 15 μm. Thus, a display sheet having the structure shown in FIG. 2 is prepared.

| Coating Composition for Active Layer: | |
|---|---|
| Azoic Yellow Pigment (Hansa Yellow) | 1 part |
| Polyester Series Binder (Vylon ® 200, trade name, made by Toyobo Co., Ltd.) | 1 part |
| Toluene | 10 parts |
| Methyl Ethyl Ketone | 10 parts |

| Coating Composition for Adhesive Layer: | |
|---|---|
| Acrylic Adhesive (Oribine ® BPS1109, trade name, made by Toyo Ink Manufacturing Co., Ltd.) (40% toluene solution) | 100 part |
| Isocyanate Series Hardening Agent (BHS8515, trade name, made By Toyo Ink Manufacturing) Co., Ltd.) | 1 part |
| Ethyl Acetate | 10 parts |

The display sheet was attached to the surface of the bulbs of a straight tube type fluorescent lamp FL40SS EX-N/37 and an annular fluorescent lamp FCL30EX-D/28 as shown in FIG. 1 to provide lighting lamps. Using each of the lighting lamps, a lighting test was performed.

As the result thereof, the active layer excluding the portions being contact with the adhesive layers caused fading in proportion to the lighting time and became colorless. The active layer showed uniform fading with the passage of time, caused no color unevenness during fading, could accurately determine the time when the active layer was faded and became colorless, and the display sheet could be used as the display of previously notifying the integrated lighting time or the life of the lamp, that is, of the time of renewing the lamp.

EXAMPLE 2

To the other side of the support of the display sheet prepared by the same manner as Example 1 was applied a masking print by a gravure system using a gold ink for gravure printing such that a circular display portion was formed as shown in FIG. 5.

Lighting lamps were prepared as in Example 1 using the display sheet thus prepared and a lighting test was performed on each of the lighting lamps. As the result thereof, the circular display portion having no printing ink became colorless and transparent. In the case of this example, the print was applied to the peripheral portion of the display portion, whereby the position of the display portion was clear and hence the discoloring, fading, etc., of the display sheet were very easily determined. Also, since the adhesive layer was hidden by the masking print, the existence thereof was respectable and the appearance of the display sheet could be improved.

EXAMPLE 3

On the surface of the display sheet having applied thereto the masking print obtained as in Example 2, a transparent polyester film of 25 μm in thickness was laminated thereto as a cover film using an adhesive having the following composition.

| Adhesive Composition: | |
|---|---|
| Acrylic Adhesive (Finetak ® SPS1011, trade name, made by Dainippon Ink and Chemicals, Inc.) | 10 parts |
| Ethyl Acetate | 10 parts |

Lighting lamps were prepared as in Example 1 using the display sheet thus prepared and a lighting test was performed as in Example 1. As the result thereof, the circular display portion having no ink became colorless and transparent. In the case of this example, neither stains such as fingerprint, etc., nor scratches formed on the masking print while working and handling for attaching the display sheet due to the existence of the cover film.

EXAMPLE 4

By following the same procedure as in Example 1 except that on the support as in Example 1, a coating composition for forming active light-adjusting layer having the composition shown below formed an active light-adjusting layer of 5 μm in thickness between the support and the active layer, a display sheet was prepared.

| Coating Composition for Active Light-Adjusting Layer: | |
|---|---|
| 2(3,5-Di-t-pentyl-2-hydroxyphenyl)-benzotriazole | 3 parts |
| 10% Toluene Solution of Polymethyl Methacrylate | 100 parts |

Lighting lamps were prepared as in Example 1 using the display sheet thus prepared. On the lighting lamps prepared, a comparison lighting test with a lighting lamp having a display sheet without forming the active light-adjusting layer was performed, and it was confirmed that the display sheet having the active light-adjusting layer showed a good reproducibility of a fading time and hence fading by external light could be prevented by the existence of the active light-adjusting layer.

EXAMPLE 5

By following the same procedure as in Example 1 except that the active light-adjusting layer as in Example 4 was formed between the active layer and the adhesive layer, a display sheet was prepared, and by the same manner as in Example 1, lighting lamps were prepared.

When on the lighting lamps thus prepared, a comparison lighting test with the case of not forming the active light-adjusting layer was performed, it was confirmed that the fading time was prolonged in the case of forming the active light-adjusting layer. Accordingly, it was confirmed that the fading time could be controlled by forming the active light-adjusting layer.

In addition, in the aforesaid examples, the pigment which was faded and became transparent by the action of an active light was used for the active layer but a dye or a mixture of a dye and a pigment causing coloring or discoloring by the action of an active light can be used for the active layer.

The lighting lamp of this invention having the aforesaid construction has the following effects.

Since a hollow space is formed between the light-susceptible layer and the lamp surface, the occurrence of coloring, fading, or discoloring is assured and also the formation of color unevenness, etc., can be prevented. Accordingly, by observing the state of coloring, fading, or discoloring of the display sheet, the integrated lighting time and the life of a lamp can be previously known and the time for renewing the lamp can be accurately determined.

Also, when a masking print is applied to the other surface of the support, the position of the display portion is clarified as well as the portion of existing adhesive layer could be hidden, whereby the state of coloring, fading or discoloring of the display sheet can be more accurately determined, and also the masking print makes the appearance of the display sheet or the lamp beautiful.

Furthermore, when a cover film is laminated on the surface of the masking print, fading of the masking print is prevented as well as the occurrence of stains or scratches on the surface of the masking print can be prevented, whereby the commercial value of the lighting lamp having laminated thereon such a display sheet is not reduced. Also, by the existence of the cover film, the occurrence of coloring, fading, or discoloring of the display portion by external light can be prevented.

While the invention has been described in detail and with reference to specific embodiments thereof, it will be apparent to one skilled in the art that various changes and modifications can be made therein without departing from the spirit and scope thereof.

What is claimed is:

1. A lighting lamp having a display sheet laminated on the surface of a bulb thereof, said display sheet comprising a support having laminated thereon a light-susceptible layer including an active layer containing at least one of a dye and a pigment capable of coloring, fading, or discoloring by the action of an active light and an adhesive layer formed on the surface of the light-susceptible layer such that the portion corresponding to at least the display portion thereof is exposed, and being laminated on the surface of the bulb by the adhesive layer.

2. The lighting lamp as in claim 1, wherein said light-susceptible layer is comprised of the active layer containing at least one of a dye and a pigment capable of coloring, fading, or discoloring by the action of an active light and an active light-adjusting layer.

3. A lighting lamp having a display sheet laminated on the surface of a bulb thereof, said display sheet comprising a support having laminated on one surface thereof a light-susceptible layer including an active layer containing at least one of a pigment or a dye capable of coloring, fading, or discoloring by the action of an active light and an adhesive layer formed on the surface of the light-susceptible layer such that the portion corresponding to at least the display portion thereof is exposed, a masking print being further applied to the other surface of the support, and being laminated on the surface of the bulb by the adhesive layer.

4. The lighting lamp as in claim 3, wherein said light-susceptible layer is comprised of the active layer containing at least one of a pigment and a dye capable of coloring, fading, or discoloring by the action of an active light and an active light-adjusting layer.

5. A lighting lamp having a display sheet laminated on the surface of a bulb thereof, said display sheet comprising a support having laminated on one surface thereof a light-susceptible layer including an active layer containing at least one of a pigment and a dye capable of coloring, fading, or discoloring by the action of an active light and an adhesive layer formed on the surface of the light-susceptible layer such that the portion corresponding to at least the display portion thereof is exposed, a masking print being applied to the other surface of the support and a cover sheet being laminated thereon, and being laminated on the surface of the bulb by the adhesive layer.

6. The lighting lamp as in claim 5, wherein said light-susceptible layer is comprised of the active layer containing at least one of a pigment and a dye capable of coloring, fading, or discoloring by the action of an active light and an active light-adjusting layer.

* * * * *